US010145373B2

(12) United States Patent
Murase et al.

(10) Patent No.: US 10,145,373 B2
(45) Date of Patent: Dec. 4, 2018

(54) ROTARY COMPRESSION MECHANISM

(71) Applicants: DENSO CORPORATION, Kariya, Aichi-pref. (JP); NIPPON SOKEN, INC., Nishio, Aichi-pref. (JP)

(72) Inventors: Yoshinori Murase, Kariya (JP); Masami Sanuki, Kariya (JP); Masashi Higashiyama, Kariya (JP); Hiroshi Ogawa, Nagoya (JP)

(73) Assignees: DENSO CORPORATION, Kariya, Aichi-pref. (JP); SOKEN, INC., Nisshin, Aichi-pref. (JP)

( * ) Notice: Subject to any disclaimer, the term of this patent is extended or adjusted under 35 U.S.C. 154(b) by 206 days.

(21) Appl. No.: 14/895,166

(22) PCT Filed: May 26, 2014

(86) PCT No.: PCT/JP2014/002739
§ 371 (c)(1),
(2) Date: Dec. 1, 2015

(87) PCT Pub. No.: WO2014/196147
PCT Pub. Date: Dec. 11, 2014

(65) Prior Publication Data

US 2016/0115957 A1 Apr. 28, 2016

(30) Foreign Application Priority Data

Jun. 6, 2013 (JP) ..... 2013-119924

(51) Int. Cl.
*F04C 18/332* (2006.01)
*F04C 18/336* (2006.01)
(Continued)

(52) U.S. Cl.
CPC ..... *F04C 18/332* (2013.01); *F04C 18/336* (2013.01); *F04C 29/0057* (2013.01);
(Continued)

(58) Field of Classification Search
CPC .... F04C 18/322; F04C 18/336; F04C 18/342; F04C 2/332; F04C 2/324; F04C 21/005
(Continued)

(56) References Cited

U.S. PATENT DOCUMENTS 448,607 A * 3/1891 Gollings ..... F01C 1/32
418/61.1
1,350,159 A * 8/1920 Johnson ..... F01C 1/336
418/61.1
(Continued)

FOREIGN PATENT DOCUMENTS

GB 363471 A 12/1931
JP H01054560 B2 11/1989
(Continued)

OTHER PUBLICATIONS

International Search Report and Written Opinion (in Japanese with English Translation) for PCT/JP2014/002739, dated Aug. 26, 2014; ISA/JP.

*Primary Examiner* — Charles Freay
*Assistant Examiner* — Thomas Fink
(74) *Attorney, Agent, or Firm* — Harness, Dickey & Pierce, P.L.C.

(57) ABSTRACT

A rotary compression mechanism includes: a shaft attached to a casing; a drive cylinder rotatably supported on the shaft; a rotor provided inside the drive cylinder; a transfer mechanism connecting the drive cylinder and the rotor in rotational motion at a constant speed; and a partition plate dividing a space defined between an inner periphery of the drive cylinder and an outer periphery of the rotor. The rotor has a second rotation center which is eccentric with respect to a first rotation center of the drive cylinder such that the outer periphery of the rotor is in contact with the inner periphery of the drive cylinder at a contact portion. The partition plate has a structure by which one end of the partition plate is let
(Continued)

in and out in a vicinity of the inner periphery of the drive cylinder or in a vicinity of the outer periphery of the rotor.

11 Claims, 10 Drawing Sheets

(51) Int. Cl.
*F04C 29/00* (2006.01)
*F04C 29/06* (2006.01)

(52) U.S. Cl.
CPC ..... *F04C 29/0085* (2013.01); *F04C 29/06* (2013.01); *F04C 2240/603* (2013.01)

(58) Field of Classification Search
USPC ..... 418/58, 62, 63, 67
See application file for complete search history.

(56) References Cited

U.S. PATENT DOCUMENTS 2,420,124 A * 5/1947 Chilton ..... F04C 18/322 417/105
2,423,507 A * 7/1947 Lawton ..... F04C 2/336 418/61.1
2,440,593 A * 4/1948 Miller ..... F04C 18/324 417/372
2,695,597 A * 11/1954 Griffiths ..... F03C 2/30 418/59
3,291,063 A * 12/1966 Jacobs ..... F01C 1/32 418/139
3,703,344 A * 11/1972 Reitter ..... F01C 1/328 418/184
3,778,197 A * 12/1973 Takagi ..... F04C 2/103 418/160
3,901,630 A * 8/1975 Kilmer ..... F01C 1/104 418/186
3,905,727 A * 9/1975 Kilmer ..... F01C 1/104 418/186
3,909,161 A * 9/1975 Stenner ..... F01C 1/328 418/6
3,981,641 A * 9/1976 D'Amato ..... F01C 1/32 418/102
4,411,190 A * 10/1983 Kilmer ..... F01B 1/06 137/625.2
4,692,104 A * 9/1987 Hansen ..... F04C 2/32 418/137
4,886,433 A * 12/1989 Maier ..... F01C 1/0246 418/55.2
4,915,071 A * 4/1990 Hansen ..... F01C 1/32 123/242
5,147,192 A * 9/1992 Suzuki ..... F01C 17/06 418/55.3
5,366,359 A * 11/1994 Bookbinder ..... F04C 18/0215 418/151
7,438,543 B2 * 10/2008 Beez ..... F04C 2/348 418/172
2002/0150485 A1 10/2002 Mori et al.
2010/0310400 A1 12/2010 Hou
2010/0310401 A1 12/2010 Ooi et al.
2012/0076678 A1 3/2012 Yamashita
2015/0176583 A1 6/2015 Murase et al.

FOREIGN PATENT DOCUMENTS

JP H05087072 A 4/1993
JP H07229480 A 8/1995
JP 2002310073 A 10/2002
JP 2011511198 A 4/2011
JP 2011512481 A 4/2011
JP 2012067735 A 4/2012
JP 2014005795 A 1/2014

* cited by examiner

ROTARY COMPRESSION MECHANISM

CROSS REFERENCE TO RELATED APPLICATIONS

This application is a U.S. National Phase Application under 35 U.S.C. 371 of International Application No. PCT/JP2014/002739 filed on May 26, 2014 and published in Japanese as WO 2014/196147 A1 on Dec. 11, 2014. This application is based on and claims the benefit of priority from Japanese Patent Application No. 2013-119924 filed on Jun. 6, 2013. The entire disclosures of all of the above applications are incorporated herein by reference.

TECHNICAL FIELD

The present disclosure relates to a rotary compression mechanism.

BACKGROUND ART

A size reduction of a compressor is required when low cost and ease of installation to a vehicle are concerned. Disposing a compression portion inside a drive motor is effective in reducing a size. PTL 1 discloses a compressor having a compression portion disposed inside a motor. PTL 1 discloses a compressor including a cylinder formed integrally with a rotor of an electric motor and a stationary piston provided eccentrically with respect to the cylinder. A compression chamber is formed between the cylinder and the piston using a vane portion (partition plate). The cylinder integral with the rotor is configured so as to rotate with respect to the piston in a stationary state, in comparison with a normal rolling piston. The cylinder integral with rotor, however, is fundamentally a normal rolling piston and therefore has a vane nose, which gives rise to a sliding loss. Because a spring and the vane are disposed to the rotating cylinder portion, a centrifugal force is exerted at high-speed rotation. When the centrifugal force becomes larger than the spring force, a clearance (fall-off of the vane) is generated between the vane nose and the rotor. In such a case, a compression operation is no longer performed and performance is deteriorated. Hence, PTL 1 is not suitable for a high-speed operation.

PTL 2 discloses a two-way rotary scroll compressor. An operation chamber can be formed in the two-way rotary scroll compressor without a vane. However, the cost increases due to precision work on a scroll in PTL 2. In addition, because a fixed scroll board of a typical scroll compressor is rotated, two scroll boards have to be supported in the manner of a cantilever. The scroll boards have unbalance and vibrate when rotated in the manner of a cantilever. In the case of a scroll compressor, a discharge port has to be provided at a center and the center serves as a shaft portion. Hence, the scroll compressor is configured in such a manner that a discharged high-pressure refrigerant passes through the rotating shaft portion. On the contrary, a drawing pressure on the periphery of the shaft portion is low. It is therefore difficult to seal the rotating shaft portion.

PRIOR ART LITERATURES

Patent Literature

PTL 1: JP H01-54560 B2
PTL 2: JP 2002-310073 A

SUMMARY OF INVENTION

The present disclosure has an object to provide a highly-efficient and highly-reliable rotary compression mechanism capable of reducing a size and minimizing a noise.

According to an aspect of the present disclosure, a rotary compression mechanism includes: a shaft attached to a casing; a drive cylinder rotatably supported on the shaft and having an inner surface of a cylindrical shape or an inner surface of a variant shape; a rotor provided inside the drive cylinder and having a second rotation center which is eccentric with respect to a first rotation center of the drive cylinder such that an outer periphery of the rotor is in contact with an inner periphery of the drive cylinder at a contact portion; a transfer mechanism connecting the drive cylinder and the rotor to set the drive cylinder and the rotor in rotational motion at a constant speed; and a partition plate dividing a space defined between the inner periphery of the drive cylinder and the outer periphery of the rotor. The partition plate has a structure by which one end of the partition plate is let in and out in a vicinity of the inner periphery of the drive cylinder or in a vicinity of the outer periphery of the rotor.

DESCRIPTION OF EMBODIMENTS

Figure 1:
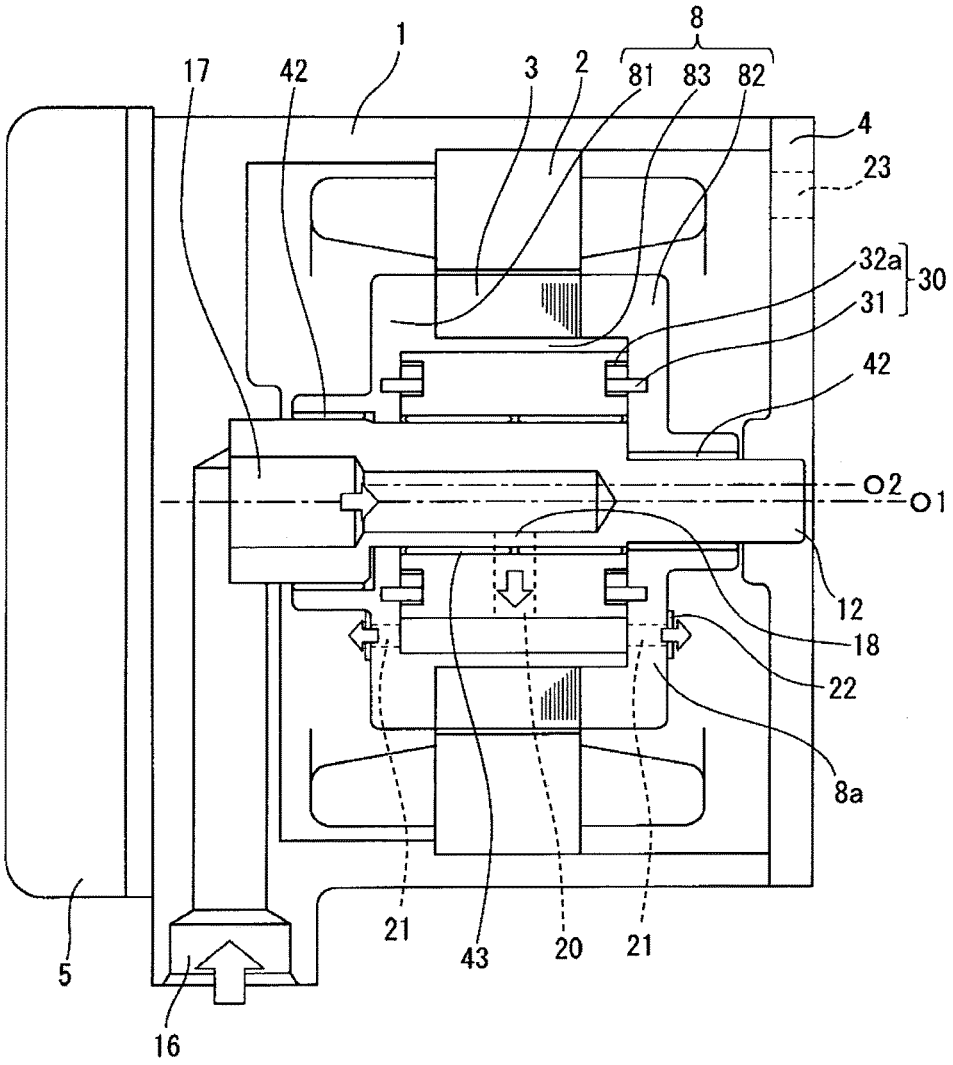
FIG. 1 is a schematic sectional view of a compressor according to a first embodiment.

Hereinafter, embodiments will be described with reference to the drawings. In the respective embodiments below, portions of same configurations are labeled with same reference numerals and a description is omitted. The embodiments below will describe refrigerant compression in an air conditioner for a vehicle by way of example. It should be appreciated, however, that the present disclosure is not limited to the example and can be applied to a broad range of compressors from home to industrial use.

First Embodiment

FIG. 1 is a horizontal sectional view of a first embodiment (a direction of the axis of rotation is set as a horizontal direction). As shown in FIG. 1, a stator 2 of an electric motor is set in and fixed to an inner surface of a casing 1. A lid 4 is attached to the casing 1 with a fastening member such as bolt. An inverter 5 is provided to the opposite side of the lid 4 through the casing 1. A rotor 3 of the electric motor is embedded and fixed along an outer periphery of a drive cylinder 8. Hence, the drive cylinder 8 is rotated by the rotor 3 of the electric motor about a first rotation center O1 at the both ends of a shaft 12. The electric motor is not limited to the stator 2 set in the casing and the rotor 3 embedded and fixed along the outer periphery of the drive cylinder 8. The drive cylinder 8 may be rotationally driven by an electric motor connected to the drive cylinder 8 in an axial direction of the shaft. Further, the drive cylinder 8 may be rotated using a belt without using an electric motor.

In the present embodiment, the drive cylinder 8 includes a left side plate 81 and a right side plate 82 formed integrally with a cylindrical cylinder portion 83. A stacked steel plate forming the rotor 3 is sandwiched and embedded between the left side plate 81 and the right side plate 82, and fixed with fastening bolts (not shown) or the like. Right and left ends of the shaft 12 are inserted into or press-fit to the casing 1 and the lid 4 to prevent the shaft 12 from rotating. The rotor 3 of the motor and the drive cylinder 8 are formed into one unit and rotatable about the first rotation center O1 via bearings 42 with respect to the stationary shaft 12.

In the present embodiment, a center axis of the shaft 12 at the both shaft ends corresponds to the first rotation center O1 of the drive cylinder 8, and a center axis of the shaft 12 at the shaft center portion coincides with a second rotation center O2 of a rotor 11. The second rotation center O2 of the rotor 11 is eccentric with respect to the first rotation center O1 of the drive cylinder 8.

Figure 2:
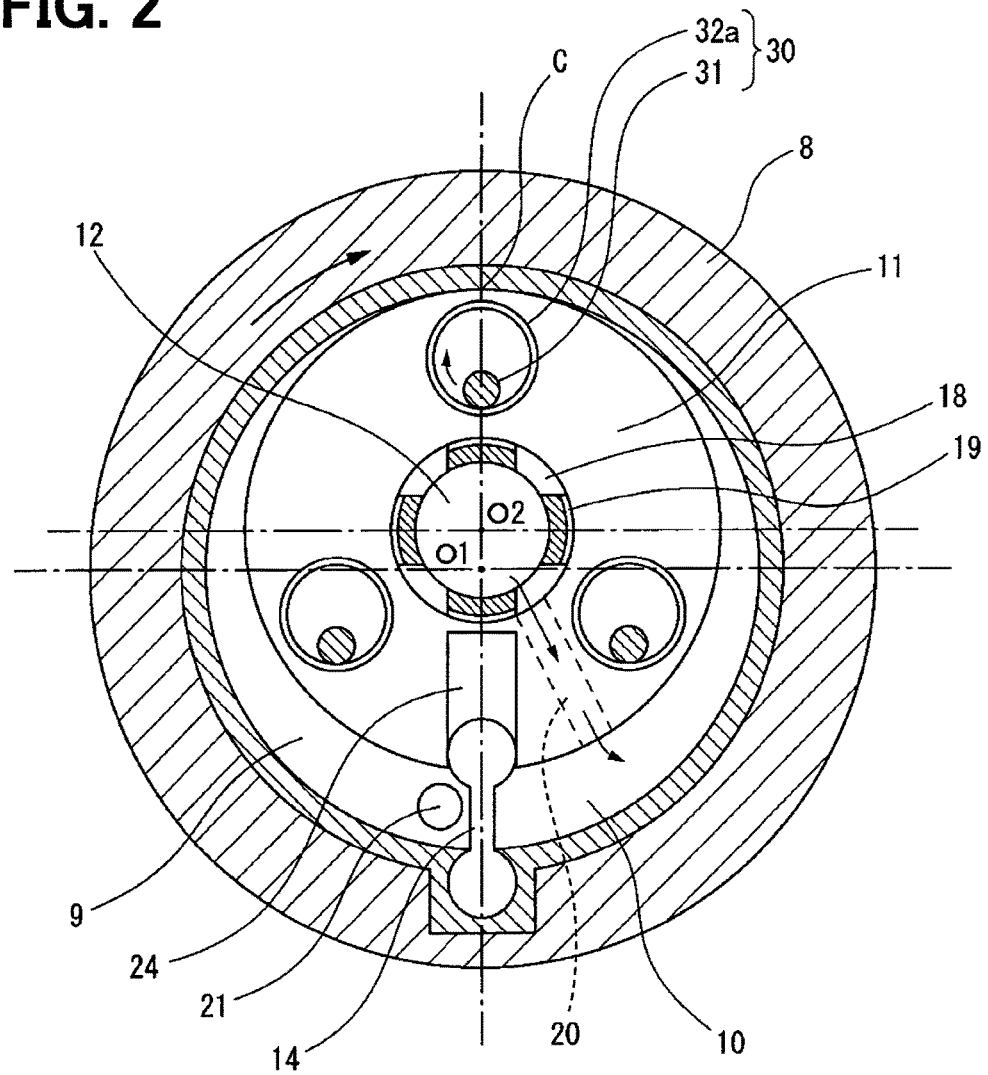
FIG. 2 is a sectional view of the compressor according to the first embodiment.

As shown in FIG. 2, the drive cylinder 8 rotates about the first rotation center O1 and the rotor 11 rotates about the second rotation center O2. Alternatively, the center axis at the both shaft ends fixed to the casing 1 may be brought in coincidence with the second rotation center O2, and the left side plate 81 and the right side plate 82 are rotatably supported on an eccentric shaft portion (first rotation center O1) from both sides of the shaft 12.

As shown in FIG. 2, the rotor 11 rotates via bearings 43 about the second rotation center O2 of the shaft center portion, which is eccentric with respect to the first rotation center O1 of the drive cylinder 8, in such a manner that an inner peripheral surface of the cylindrical cylinder portion 83 of the drive cylinder 8 and an outer periphery of the rotor 11 make contact at a partition point (referred to also as a contact portion) C. The shaft 12 itself does not rotate. Hence, both of the first rotation center O1 of the drive cylinder 8 and the second rotation center O2 in the shaft center portion are fixed points. A pin 31 is embedded in each of the left side plate 81 and the right side plate 82, and protrudes into the corresponding inner peripheral groove 32 defined on the both side surfaces of the rotor 11. The pin 31 and the inner peripheral groove 32 together form a transfer mechanism 30 that connects the drive cylinder 8 and the rotor 11 for the both to rotate at a constant speed. A ring 32*a* is inserted into the respective inner peripheral groove. Multiple sets of the pin 31 and the ring 32*a* (transfer mechanism 30) are generally referred to as a rotation preventing pin and ring mechanism, and transfer rotations of the drive cylinder 8 to the rotor 11 at a constant rotation speed in the same manner as an Oldham's coupling. In order to prevent seizing and a reduction of a relative speed, it is preferable to insert the ring 32*a* made of a sliding material with excellent abrasion resistance and low frictional properties into the inner peripheral groove 32. The rotor 11 and the drive cylinder 8 may be connected to each other with an Oldham's coupling instead of multiple sets of the pin 31 and the ring 32*a* as disclosed in JP H07-229480 A.

At least two sets of the pin 31 and the ring 32*a* are necessary. A preferable configuration to prevent the occurrence of unbalance weight is to dispose three sets at a regular interval of 120° or four sets at a regular interval of 90°. It goes without saying, however, that it is possible to implement with the multiple sets even at irregular intervals. The ring 32*a* is inserted into the inner peripheral groove in the present embodiment. However, it is possible to implement even when the ring is not inserted into the inner peripheral groove 32.

A partition plate 14 is provided between the drive cylinder 8 and the rotor 11. In the embodiment of FIG. 2, the partition plate 14 is of a dumbbell shape in the cross-section. One end of the partition plate 14 is attached swingably to the cylindrical cylinder portion 83 of the drive cylinder 8 and the other end of the partition plate 14 is attached to the rotor 11 slidably and swingably inside a slide groove 24. Rotations of the drive cylinder 8 are transferred by the transfer mechanism 30. Hence, the partition plate 14 does not drag the rotor 11 to rotate. The partition plate 14 is furnished with a sole function of dividing an operation chamber with the partition point C.

By referring to FIG. 2, the rotational center of the rotor 11 (the second rotation center O2 in the center portion of the shaft 12) is eccentric with respect to the first rotation center O1 of the drive cylinder 8 (the rotor 3 of the electric motor), and each of the rotor 11 and the drive cylinder 8 rotates at a constant speed. The first rotation center O1 and the second rotation center O2 are fixed points. Hence, in the present embedment, the partition point C remains also as a fixed point even when the drive cylinder 8 and the rotor 11 rotate, which will be described below with reference to FIG. 3A.

The partition plate 14 will now be described. The partition plate 14 is a member corresponding to a vane in a rolling piston. That is to say, in the present embodiment, the partition plate 14 is a member that separates a compression chamber (operation chamber on the compression side) 9 and an inlet chamber 10 from each other. In order to function as a connection member, one end (head) of the partition plate 14 is made into a cylindrical surface. The partition plate 14 is thus swingable with respect to a center axis of the head. The rotor 11 and the drive cylinder 8 rotate at a constant speed, during which the other end (foot) of the partition plate 14 slides linearly inside the slide groove 24 by swinging slightly. As with the head, the foot is made into a cylindrical surface. Hence, the partition plate 14 is shaped like a dumbbell in the cross-section.

Figure 4:
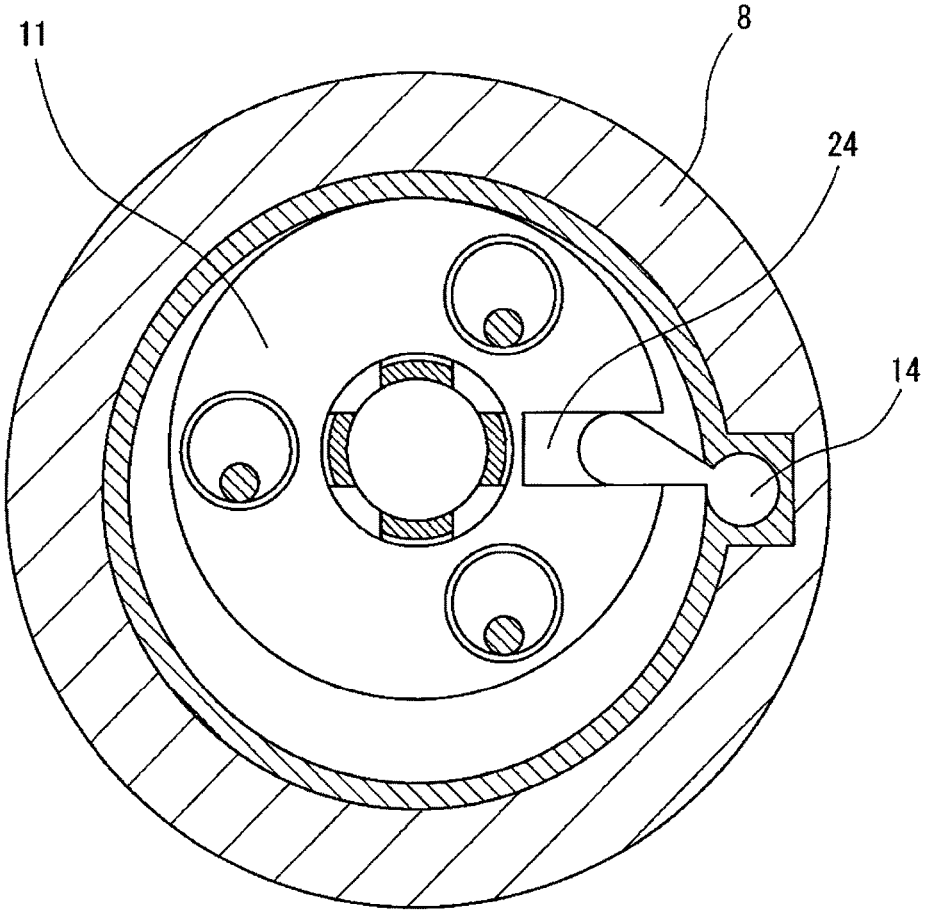
FIG. 4 is a sectional view showing a partition plate in the compressor according to the first embodiment.

However, the sectional shape of the partition plate 14 is not limited to a dumbbell shape and can be modified in various manners. As shown in FIG. 4, the section may be shaped like an exclamation mark. In this case, because a dead volume in the operation chamber where compression takes place is reduced, it is effective in the compression efficiency.

Figure 9:
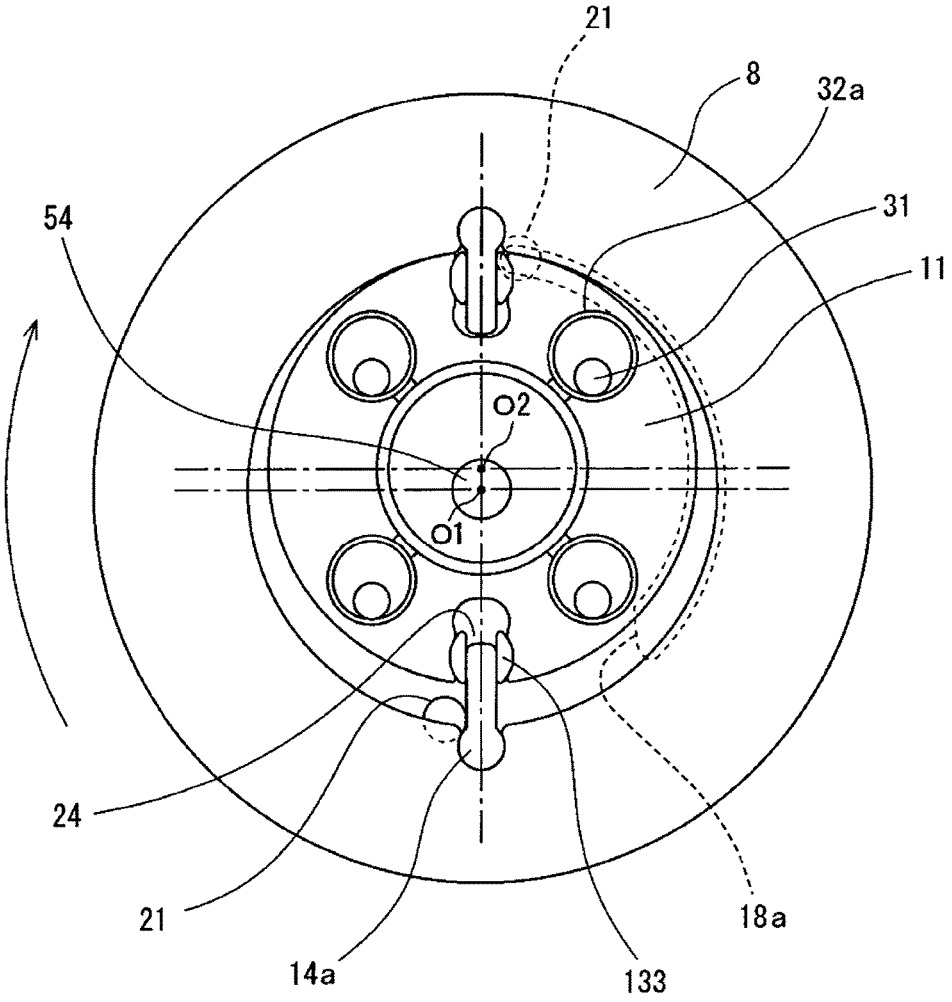
FIG. 9 is a sectional view of a compressor according to a third embodiment.

Further, the present embodiment may adopt a partition plate 14*a* as shown in FIG. 9 described below. The partition plate 14*a* has a head made into a cylindrical surface and the other end formed of a flat plate with no head. Two shoes 133 each having a cylindrical surface on one side are provided to the rotor 11 so as to sandwich the flat plate at the other end of the partition plate 14*a*. Consequently, the other end of the partition plate 14*a* is attached to the rotor 11 slidably and swingably. In this case, it is quite effective in the compression efficiency because a dead volume in the slide groove 24 can be eliminated completely. The partition plate 14 can be shaped like a dumbbell or an exclamation mark in the cross-section and also modified like the partition plate 14*a* sandwiched between the two shoes 133. In any case, the number of the partition plate 14 or 14*a* is not limited to one and more than one partition plate 14 or 14*a* may be provided as shown in FIG. 9. When two or more partition plates 14 or 14*a* are provided, drawing may be performed from inside the shaft 12 through an inlet channel as in the present embodiment or performed from an inlet opening 18*a* provided to the casing as in a second embodiment described below.

An inlet channel 17 penetrates through an internal center of the shaft 12 which is fixed to the casing. Hence, differently from PTL 2, the inlet channel 17 does not rotate and is therefore readily sealed. In order to enable communication from the inlet channel 17 to a rotor channel 20, as shown in FIG. 2, a shaft opening 18 is provided at four points in a radial direction as one example. As shown in FIG. 1 and FIG. 2, a compression medium, such as a refrigerant gas to be compressed, is introduced from an inlet port 16 to pass through the inlet channel 17, and introduced into the operation chamber (inlet chamber) 10 on the inlet side from the shaft opening 18 and the rotor channel 20. The shaft opening 18 and the rotor channel 20 always communicate with each other at any angle. A groove 19 is provided along a whole circumference at outlets of the shaft openings 18 in a circumferential direction in a part of the shaft 12.

A compression chamber discharge port 21 is provided to each of the left side plate 81 and the right side plate 82 of the drive cylinder 8, and a discharge valve portion 22 is provided outside of the compression chamber discharge port 21. The compression chamber discharge ports 21 and the discharge valve portions 22 rotate as the drive cylinder 8 rotates and discharge the compression gas into an internal space of the casing while rotating. Thereafter, the compression gas is discharged to the outside from a casing discharge port 23. The discharge valve portion 22 may be provided to an outer peripheral portion of the drive cylinder 8.

A compression mechanism portion includes the shaft 12 fixed to the casing 1, the drive cylinder 8, the rotor 11, and the partition plate 14 connecting the drive cylinder 8 and the rotor 11. The second rotation center O2 of the rotor 11 is eccentric with respect to the first rotation center O1 of the drive cylinder 8. A space between the rotor 11 and the drive cylinder 8 is defined as the operation chamber. The operation chamber is divided to two by the partition plate 14 to form the compression chamber 9 and the inlet chamber 10. The drive cylinder 8 is rotated by the electric motor 2, 3 that rotationally drives the drive cylinder 8. During the rotation, an inlet gas is compressed in the compression chamber 9, which is one of the operation chambers between the drive cylinder 8 and the rotor 11 and formed in front of the partition plate 14 in a rotation direction. The operation chamber formed between the drive cylinder 8 and the rotor 11 is divided by the partition plate 14 and the partition point C which is a contact point of the drive cylinder 8 and the rotor 11. The compression chamber 9 is formed in front of the partition plate 14 in the rotation direction and the inlet chamber 10 is formed behind the partition plate 14.

Figure 3A:
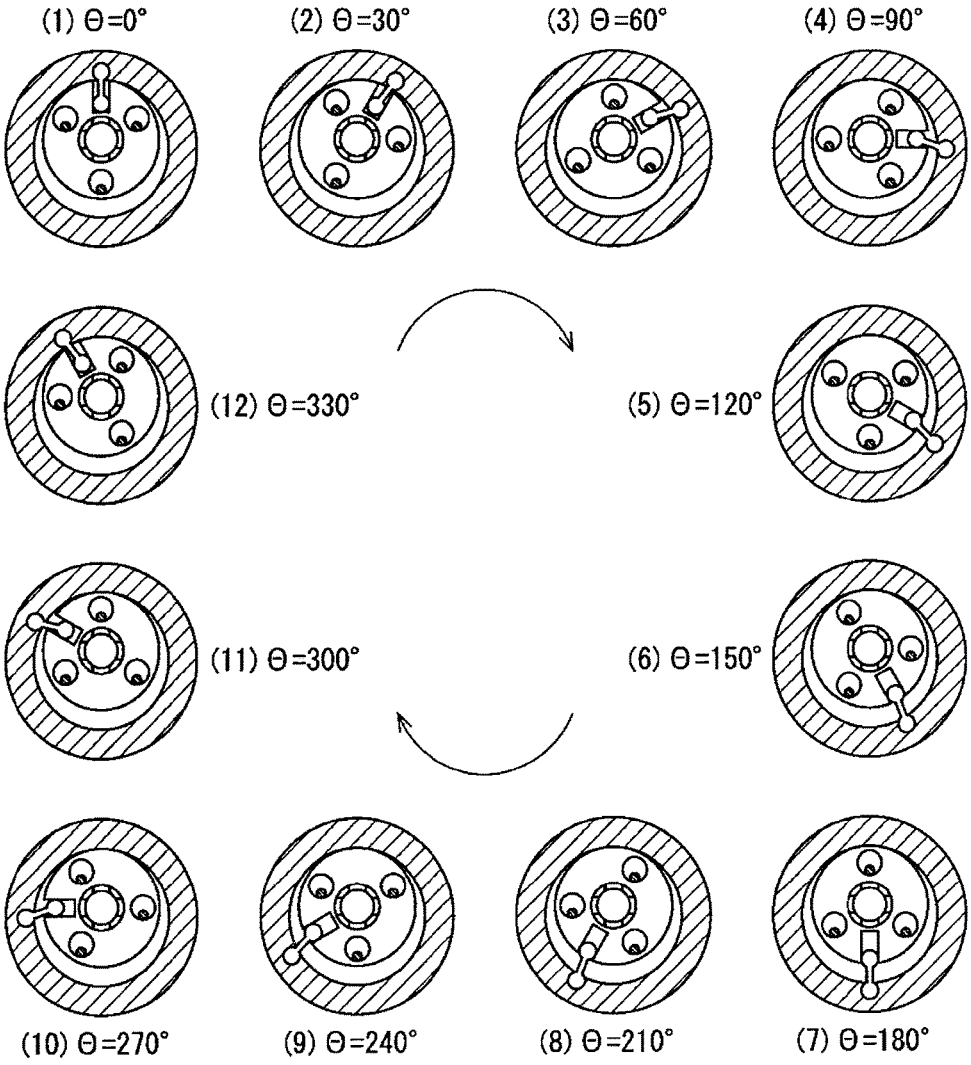
FIG. 3A is a view to describe an operation of the compressor according to the first embodiment.
Figure 3B:
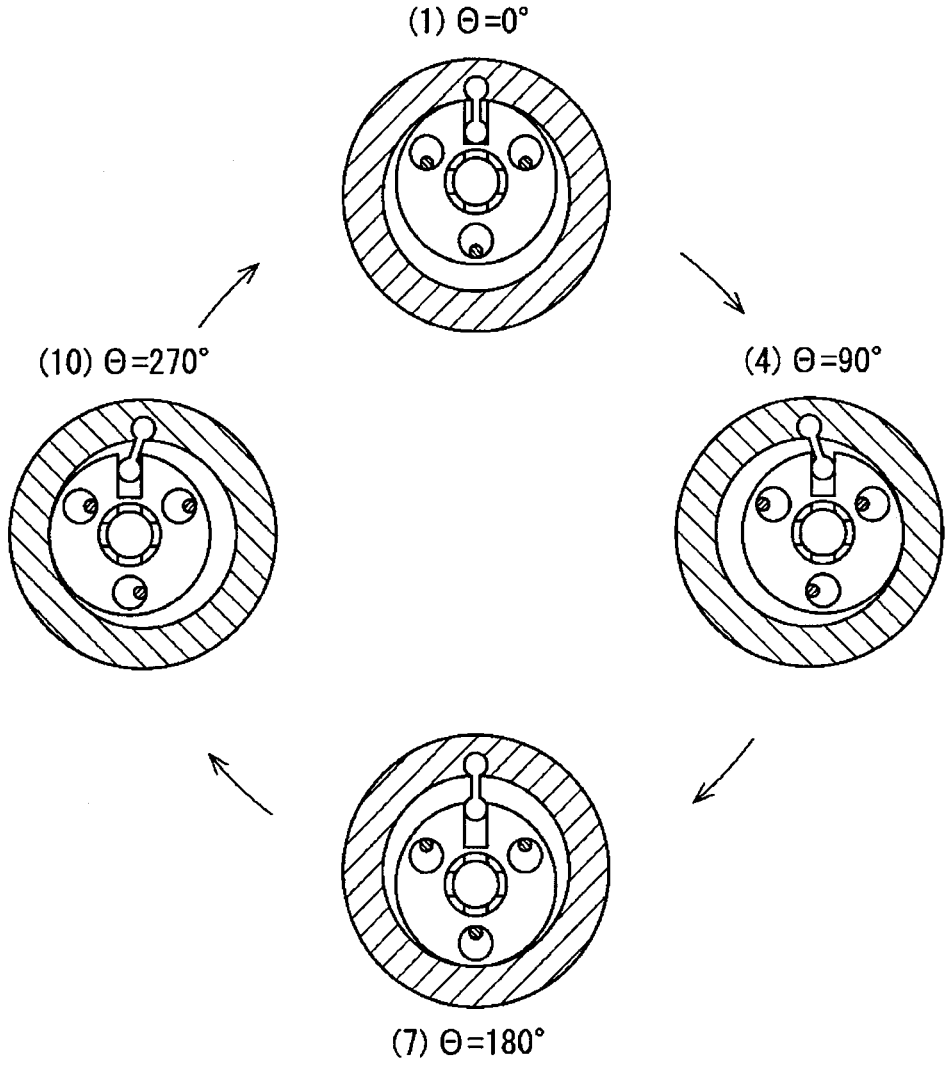
FIG. 3B is another view to describe an operation of the compressor according to the first embodiment.

FIG. 3A is a view to describe an operation of the compressor according to the first embodiment in which the first rotation center O1 and the second rotation center O2 are fixed. FIG. 3B is a view to describe an operation of the compressor according to the first embodiment when an operation of the rotor 11 is shown relatively by setting the drive cylinder 8 on a coordinate at rest.

A compression process and a drawing process will be described with reference to FIG. 3A in which a rotation angle θ of the drive cylinder 8 (position of the head of the partition plate 14) is controlled by 30°. FIG. 3A shows actual positions of the compression mechanism at the respective angles while the drive cylinder 8 and the rotor 11 rotate at a constant speed. The first rotation center O1, the second rotation center O2, and the partition point C are fixed. When the drive cylinder 8 rotates, the rotor 11 rotates due to the pin 31 and the ring 32*a*. It should be noted, however, that the operation chamber is always divided by the partition point C.

On the other hand, FIG. 3B is a view showing motion of the rotor 11 by setting the rotating drive cylinder 8 on a coordinate system at rest for ease of understanding of a rolling piston mechanism. It is difficult to understand a state of the operation chamber from FIG. 3A because both of the drive cylinder 8 and the rotor 11 rotate. On the contrary, it can be understood from FIG. 3B that the rotor 11 rolls on the inner peripheral surface of the cylindrical cylinder portion 83 of the drive cylinder 8 in the same manner as a typical rolling piston.

A description will be given with reference to FIG. 3A in order from (1) θ=0° to (12) θ=330° and again to (1) θ=0°. For simplicity, the rotor channel 20 and the compression chamber discharge ports 21 through which a compressed fluid is drawn into the operation chamber are omitted in FIG. 3A. The compression chamber discharge port 21 is present in front of the partition plate 14 in the rotation direction and the rotor channel 20 is provided behind the partition plate 14.

During one rotation, namely 360°, the compression process and the drawing process progress simultaneously in the operation chambers, respectively, in front of and behind the partition plate 14 in the rotation direction. The compression process will be described first.

When (1) θ=0°, the drawing is completed. Because the partition plate 14 coincides with the partition point C, the drawing chamber 10 and the compression chamber 9 are united. While the rotational angle θ of the drive cylinder 8 increases from θ=0°, as can be viewed in (2) through (12), a space in front of the partition plate 14 in the rotation direction to the partition point C is closed and compression progresses in the compression chamber 9.

As can be viewed in (2) through (12), the drawing process progresses in the operation chamber behind the partition plate 14 in the rotation direction. The compression chamber 9 disappears at (1) θ=0° and in turn the drawing chamber 10 is formed in a space behind the partition plate 14 in the rotation direction from the partition point C. The drawing taking place in (2) progresses to (12) and ends in (1). Hence, the compression process and the drawing process take place repeatedly. The compression process and the drawing process have been described separately in two rotations. In practice, however, the compression process and the drawing process take place simultaneously in one rotation of 360°.

As has been described above, the rotor 11 and the drive cylinder 8 are capable of rotating simultaneously at a constant speed and both are in perfect synchronization. When the drive cylinder 8 is in constant rotational motion, no rotation fluctuation occurs in the rotor 11. Hence, a noise of the compressor can be improved markedly. In PTL 2, scroll lap teeth develop in an involute curve. It thus becomes necessary to adjust a center of gravity to fall on centers of rotation of the respective driven and drive scrolls and unbalance weight inevitably occurs.

On the contrary, according to the present embodiment, the drive cylinder 8 and the rotor 11 have simple cylindrical bodies. Moreover, the drive cylinder 8 and the rotor 11 rotate, respectively, about the first rotation center and the second rotation center which are fixed points. Hence, when all of the sets of the pin 31 and the ring 32*a* are provided at regular interval, unbalance weight does not occur or can be restricted to negligible magnitude. Consequently, the present embodiment has excellent advantageous effects from the viewpoint of vibration and noise in comparison with PTL 2.

According to the present embodiment, because the fixed shaft 12 is used as a refrigerant channel (inlet channel 17), it is not necessary to provide a wall that separates a high pressure and a low pressure as provided in a compressor in the related art. In PTL 2, a discharged refrigerant (high pressure) passes through the rotating shaft whereas a pressure on the periphery of the shaft is an inlet pressure (low pressure). Hence, PTL 2 has an issue that it is difficult to seal the rotating shaft. In contrast, according to the present embodiment, because the shaft 12 is fixed and does not rotate, a sealing mechanism can be simpler. Consequently, leakage of the refrigerant can be restricted and efficiency of the compressor can be enhanced. Also, the present embodiment does not have a vane nose sliding portion and obviously neither a fall-out nor seizing of the vane nose sliding portion occurs. Hence, performance and reliability can be ensured at the same time from low rotation to high rotation. Further, the drive cylinder 8 is disposed inside the rotor 3 of the electric motor, and a compression operation is performed by rotations of the drive cylinder 8. Therefore, a compact compressor can be provided in the rotor of the electric motor.

Second Embodiment

Figure 5:
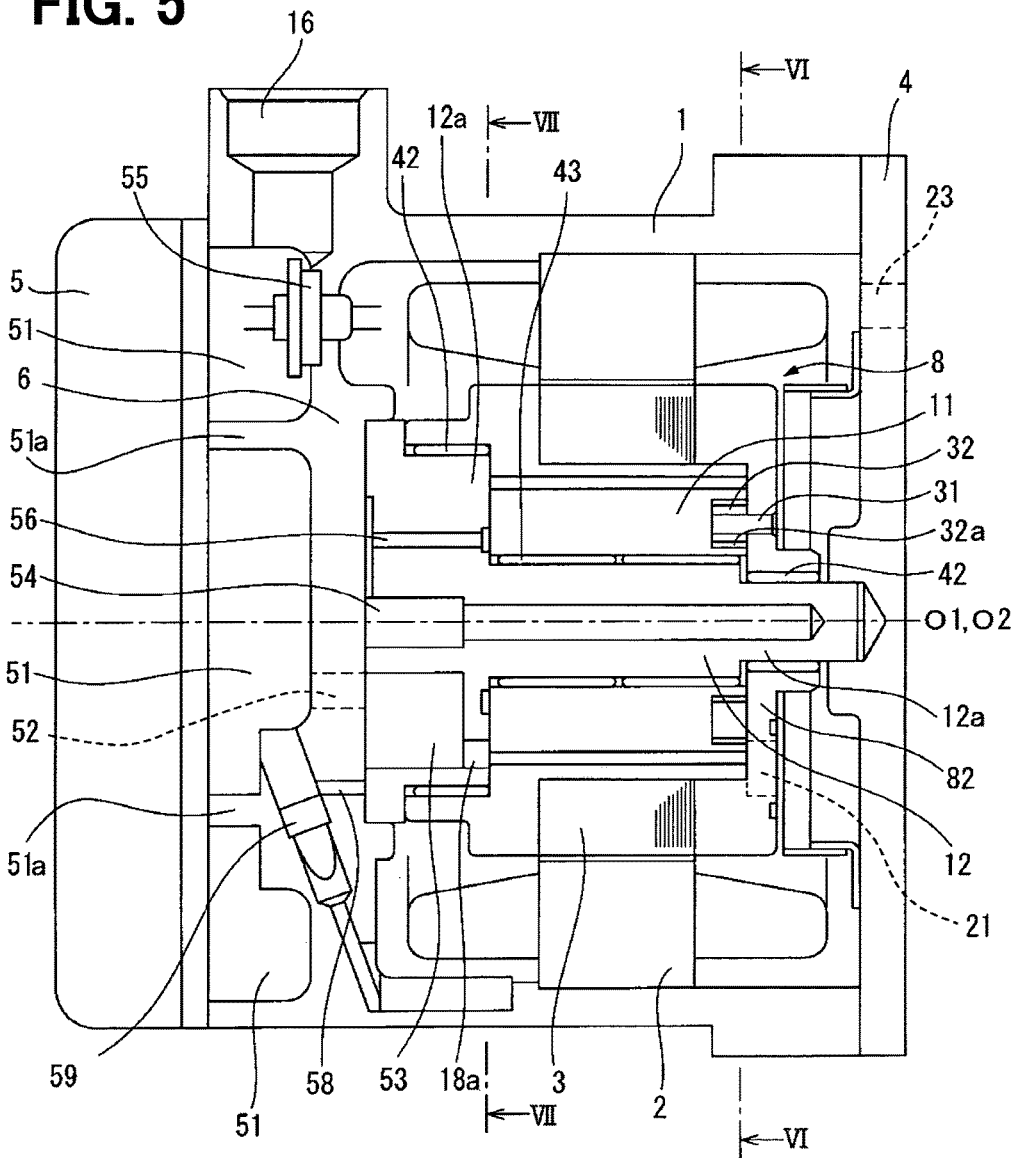
FIG. 5 is a schematic sectional view of a compressor according to a second embodiment.
Figure 6:
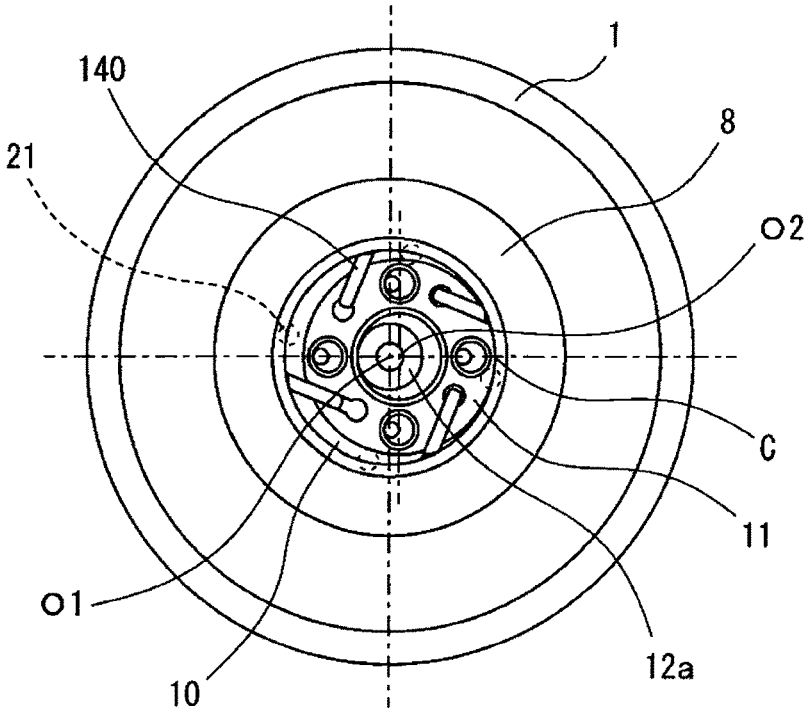
FIG. 6 is a sectional view taken along a line VI-VI of FIG. 5.

In a second embodiment, as shown in FIG. 6, a partition plate 140 is formed of a flat plate in such a manner that one end of the partition plate 140 makes contact with an inner peripheral surface of a drive cylinder 8, and four partition plates 140 are attached to a rotor 11 slidably. The present embodiment will be described with reference to FIG. 5 and FIG. 6 by omitting a description where configurations and operations are the same as those in the first embodiment. FIG. 5 and FIG. 6 are views in which a partition point C is rotated by 90° clockwise in comparison with FIG. 2.

A compression mechanism portion includes the shaft 12 fixed to a casing 1, the drive cylinder 8, the rotor 11, and the partition plate 140 connecting the drive cylinder 8 and the rotor 11. A second rotation center O2 of the rotor 11 is eccentric with respect to a first rotation center O1 of the drive cylinder 8. A fundamental configuration to transfer rotations of the drive cylinder 8 using a transfer mechanism 30 is the same as the fundamental configuration of the first embodiment. The drive cylinder 8 is made rotatable about the first rotation center O1 via bearings 42 by support portions 12*a* and 12*a* at both ends of the shaft 12 (see FIG. 6). The rotor 11 is rotatable about the second rotation center O2 via bearings 43 with respect to the shaft 12 (see FIG. 6). The rest is the same as the first embodiment.

In the second embodiment of the present disclosure, four partition plates 140 are attached to the rotor 11 slidably. However, one or more than one partition plate 140 may be used. When one partition plate 140 is used, drawing may be performed from the shaft 12 as in the first embodiment. In the present embodiment, the partition plate 140 is provided in such a manner that one end of the partition plate 140 makes contact with the inner peripheral surface of the drive cylinder 8. However, it may be configured conversely in such a manner that the partition plate 140 is provided slidably on the side of the drive cylinder 8 so that one end of the partition plate 140 makes contact with an outer peripheral surface of the rotor 11. In short, the present embodiment includes various modifications. Similarly to FIG. 3B of the first embodiment, the drive cylinder 8 and the rotor 11 rotate simultaneously. Meanwhile, according to the present embodiment, the partition plate 140 and the inner peripheral surface of the drive cylinder 8 slide on each other slightly. Hence, neither a fall-off nor seizing of a vane nose sliding portion occurs. Consequently, both performance and reliability can be ensured at the same time from low rotation to high rotation.

In the present embodiment, the shaft 12 is fixed to an inner partition plate 6 and a lid 4 formed integrally with the casing 1. The shaft 12 may be fixed to the inner partition plate 6 with bolts. In FIG. 5, an inlet volume 51 is provided on the left of the inner partition plate 6. A compression medium such as refrigerant gas to be compressed is introduced from the inlet port 16 to pass through the inlet volume 51, and is introduced to an internal inlet volume 53 between the shaft 12 and the inner partition plate 6 from a communication port 52. In FIG. 5, an interior of the inlet volume 51 is divided by an inner wall 51*a*. However, the divided volumes are of a spiral shape and all communicate with one another.

Figure 7:
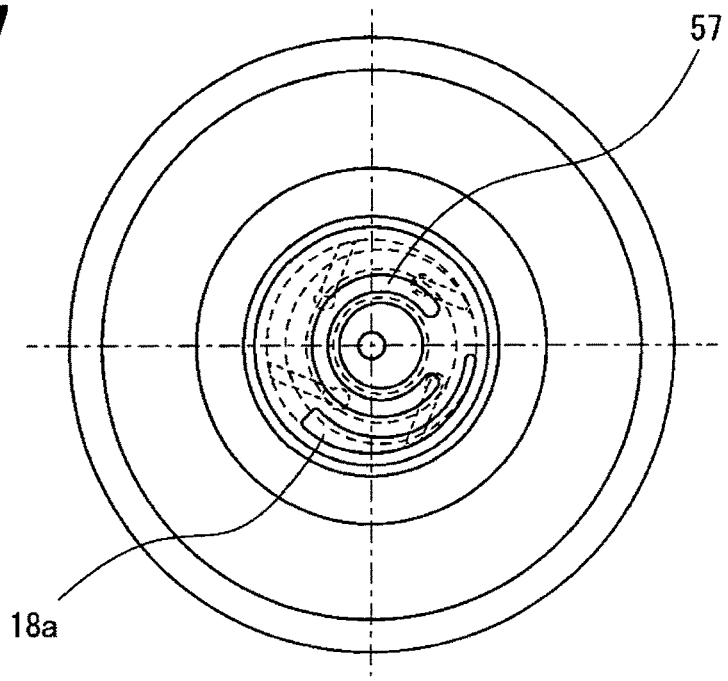
FIG. 7 is a sectional view taken along a line VII-VII of FIG. 5.

Thereafter, as shown in FIG. 7, the compression medium is introduced into an inlet chamber 10 of the compression mechanism from an inlet opening 18*a* of a crescent shape. The shape of the inlet opening 18*a* is not limited to the crescent shape. It is, however, preferable to provide an opening shape conforming to a shape of an operation chamber and extending for about 135° in a rotation direction with reference to the partition point C. An optimal angle varies with the number of cylinders. In the case of four cylinders as in the present embodiment, the optimal angle is about 135° as described above. In the case of two cylinders, the optimal angle is 90° and in the case of three cylinders, the optimal angle is 120°. That is, a value of the optimal angle is found by an expression: 180°−(180/number of cylinders). The present disclosure, however, is not limited to the configuration as above. A compression chamber discharge port 21 is provided at four points in a right side plate 82 of the drive cylinder 8, and a discharge valve portion 22 (not shown) is provided on the outside of each. The compression chamber discharge port 21 and the discharge valve portion 22 rotate as the drive cylinder 8 rotates and discharge a compression gas into an internal space of the casing while rotating. Thereafter, the compression gas is discharged to the outside from a casing discharge port 23.

A pin 31 is embedded in the right side plate 82 and protrudes into corresponding inner peripheral groove 32 on a right side surface of the rotor 11. The pin 31 and the inner peripheral groove 32 (or inner peripheral surface of ring 32*a*) together form the transfer mechanism 30. The ring 32*a* is inserted into the inner peripheral groove. In order to prevent seizing and a reduction of a relative speed, it is preferable to insert the ring 32*a* made of a sliding material with excellent abrasion resistance and low frictional properties into the inner peripheral groove 32. In the present embodiment, four sets of the pin 31 and the ring 32*a* are provided at every 90°. However, it is sufficient to provide at least two sets. Alternatively, an Oldham's coupling may be used as the transfer mechanism 30.

Differently from the first embodiment, a through-hole 54 along the first rotation center O1 in a center portion of the shaft 12 is not an inlet channel but a flow channel of lubricant oil. A compressed compression medium at a high pressure is discharged into the casing 1 and an oil reservoir is formed in a lower part of the casing. By using the internal high pressure, the lubricant oil passes through a filter 59 and a communication channel 58 and is distributed to the through-hole 54 and channels 56 and 57 by way of an oil groove (not shown) provided to a left end face of the shaft 12 in FIG. 5. The lubricant oil which has passed through the through-hole 54 is supplied to the bearings 42 and 43. Also, the lubricant oil that has passed through the channels 56 and 57 is supplied as a back pressure of the partition plate 140. The other configuration is the same as the configuration of the first embodiment.

Figure 8:
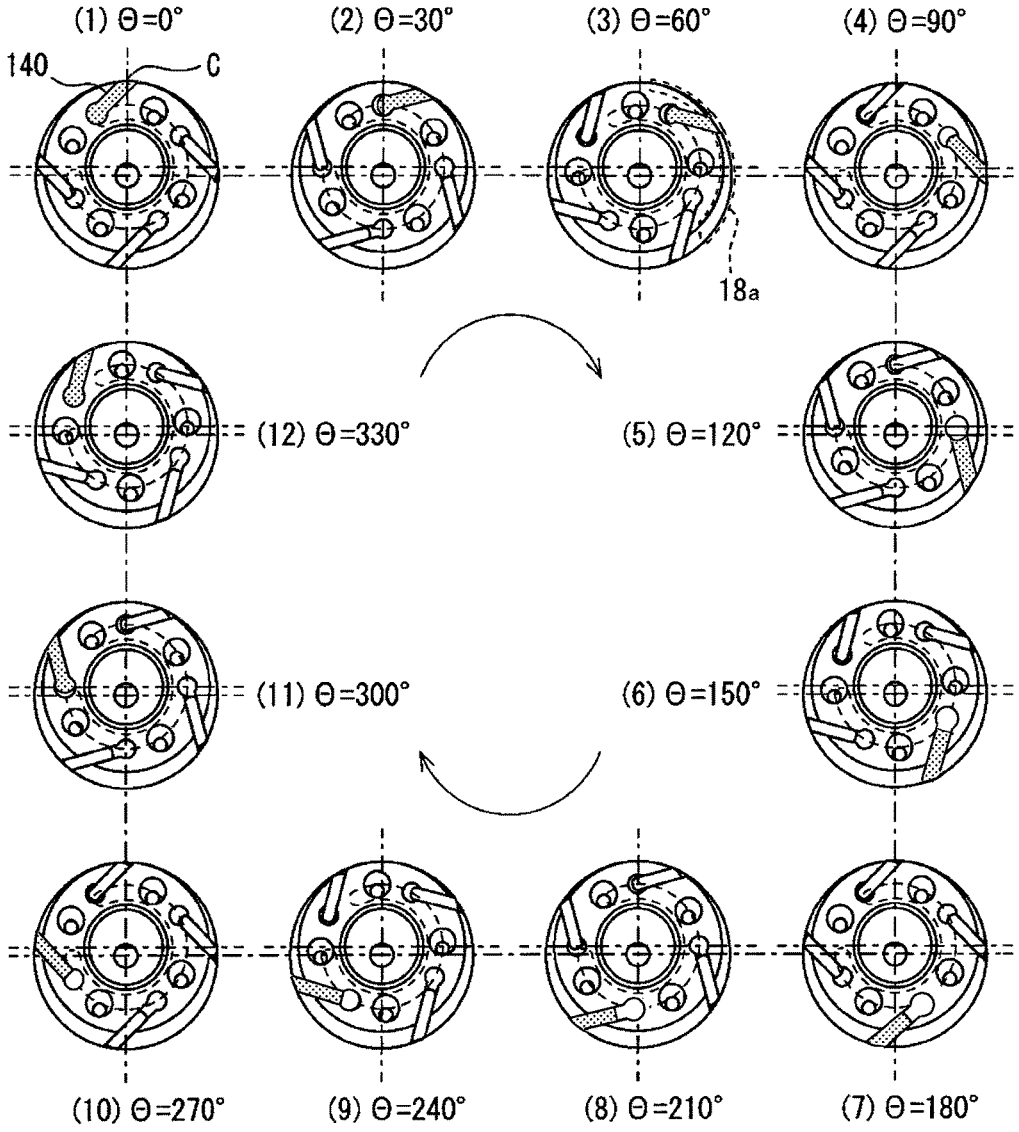
FIG. 8 is a view to describe an operation of the compressor according to the second embodiment.

A compression process and a drawing process will be described with reference to FIG. 8 in which a rotation angle θ of the drive cylinder 8 (contact position at which the partition plate 140 and the inner peripheral surface of the drive cylinder 8 make contact) is changed by 30°. In FIG. 8, a position of the partition point C of FIG. 6 rotates 90° counterclockwise and is positioned at a top, similarly to FIG. 3A. A description will be given using the hatched partition plate 140 as a representative. In FIG. 8, both of the drive cylinder 8 and the rotor 11 rotate. It should be noted, however, that the first rotation center O1, the second rotation center O2, and the partition point C are fixed in the present embodiment, too. When the drive cylinder 8 rotates, the rotor 11 rotates due to the pin 31 and the ring 32*a*. However, the operation chamber is constantly divided by the partition point C.

A description will be given with reference to FIG. 8 in order from (1) θ=0° to (12) θ=330° and again to (1) θ=0°. For simplicity, the inlet opening 18*a* of a crescent shape from which a compressed fluid is drawn into the operation chamber is explicitly shown at (3) alone. As shown in FIG. 5 and FIG. 7, the inlet opening 18*a* is provided to the stationary shaft 12 and therefore provided at a stationary position. The compression chamber discharge port 21 is provided at four points in front of the respective partition plates 140 in a rotation direction and is provided to the right side plate 82 of the drive cylinder 8. Hence, the compression chamber discharge port 21 rotates simultaneously with rotation of the drive cylinder 8. In the second embodiment of the present disclosure, the four partition plates 140 are provided to the rotor 11 slidably, and operation chambers in front of and behind the hatched partition plate 140 (hereinafter, referred to as the front operation chamber and the rear operation chamber, respectively) will be described as a representative.

At (1)θ=0°, a compression process is at a final stage in the rear operation chamber. On the other hand, drawing is just started in the front operation chamber. In the vicinity of (2), a drawing process is started in the rear operation chamber because the rear operation chamber is separated by the partition point C and the front side communicates with the inlet opening 18*a*. In the vicinity of (5), the compression process is started in the front operation chamber because the communication with the inlet opening 18*a* is interrupted. On the other hand, just after the hatched partition plate 140 passed by (8), the compression process is started in the rear operation chamber because the communication with the inlet opening 18*a* is interrupted. Accordingly, in each operation chamber, the compression process and the drawing process take place repeatedly with a phase difference of 90°. Regarding advantageous effects of the second embodiment, in comparison with the first embodiment, a displacement volume per rotation is increased because multiple operation chambers are formed. The second embodiment is therefore more advantageous from the viewpoint of a size reduction. The rest is the same as the first embodiment above except that the drawing is performed without using the shaft 12.

Third Embodiment

In a third embodiment, a compressor includes a partition plate 14*a* shown in FIG. 9. The other configuration, such as an inlet opening 18*a* and compression chamber discharge ports 21, is basically the same as the second embodiment. A head of the partition plate 14*a* is made into a cylindrical surface and the other end of the partition plate 14*a* is a flat plate. Two shoes 133 each having a cylindrical surface on one side are provided to a rotor 11 so as to sandwich the flat plate at the other end of the partition plate 14*a*. The partition plate 14*a* is thus attached to the rotor 11 so that the other end is slidable and swingable. The configuration of the partition plate 14*a* of the present embodiment is applicable to the first embodiment. The embodiment shown in FIG. 9 is a case where two partition plates 14*a* are provided. However, one or more than one partition plate 14*a* may be used. The third embodiment is quite effective from the viewpoint of compression efficiency because a dead volume in the slide groove 24 can be eliminated completely. Other advantageous effects are the same as the advantageous effects of the first and second embodiments.

Fourth Embodiment

Figure 10:
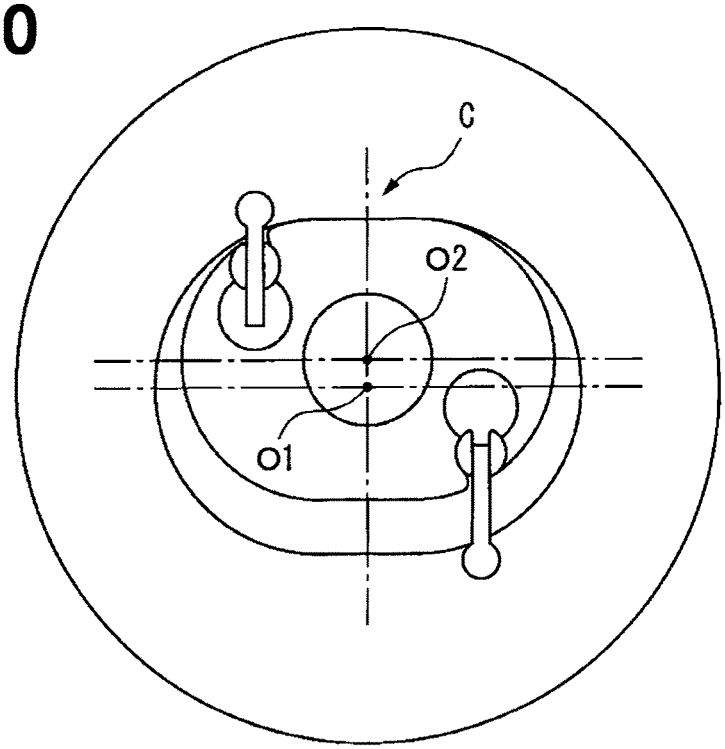
FIG. 10 is a sectional view of a compressor according to a fourth embodiment.

In a fourth embodiment, as shown in FIG. 10, an inner surface section of a drive cylinder 8 and an outer peripheral section of a rotor 11 have variant shapes. In the fourth embodiment shown in FIG. 10, the variant shape is an oval shape formed of straight lines and arcs. A partition point herein is formed of a contact portion C including a flat surface. The other configuration is the same as the configuration of the embodiment shown in FIG. 9.

Fifth Embodiment

Figure 11:
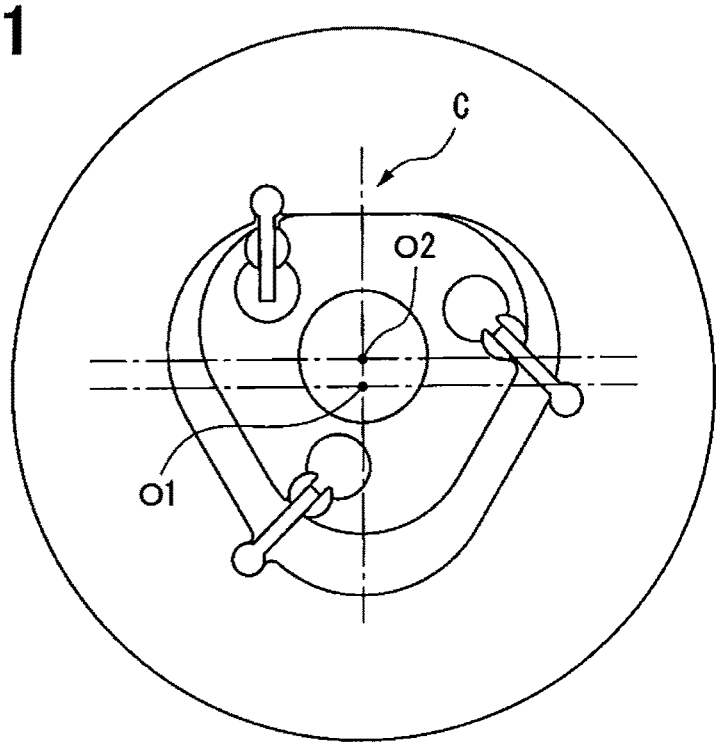
FIG. 11 is a sectional view of a compressor according to a fifth embodiment.

In a fifth embodiment, as shown in FIG. 11, an inner surface section of a drive cylinder 8 and an outer peripheral section of a rotor 11 have variant shapes. In the fifth embodiment shown in FIG. 11, the variant shape is a triangular shape with round corners formed of straight lines and arcs. A partition point herein is also formed of a contact portion C including a flat surface. The other configuration is the same as the configuration of the embodiment shown in FIG. 9.

While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. A rotary compression mechanism comprising:

a shaft attached to a casing;

a drive cylinder rotatably supported on the shaft and having an inner surface of a cylindrical shape or an inner surface of a variant shape;

a rotor provided inside the drive cylinder and having a second rotation center which is eccentric with respect to a first rotation center of the drive cylinder such that an outer periphery of the rotor is in contact with an inner periphery of the drive cylinder at a contact portion;

a transfer mechanism connecting the drive cylinder and the rotor to have rotational motion at a constant speed; and a partition plate dividing a space defined between the inner periphery of the drive cylinder and the outer periphery of the rotor, wherein the partition plate has a structure by which one end of the partition plate is let in and out in a vicinity of the inner periphery of the drive cylinder or in a vicinity of the outer periphery of the rotor, the transfer mechanism includes a plurality of sets of a pin attached to the drive cylinder, and an inner peripheral groove provided to the rotor, and the pin slides on an inner periphery of the inner peripheral groove to transfer torque to the rotor by rotation of the drive cylinder, wherein the rotor is driven by through pin without being driven through the partition plate.

2. The rotary compression mechanism according to claim 1, wherein:

the inner peripheral groove is formed of an inner peripheral surface of a ring.

3. The rotary compression mechanism according to claim 1, wherein:

the shaft and the rotor have an inlet channel to draw into an operation chamber, and a discharge valve portion is provided to a side surface portion or an outer peripheral portion of the drive cylinder to discharge.

4. The rotary compression mechanism according to claim 1, wherein:

the one end of the partition plate is swingably attached to the drive cylinder, and the other end of the partition plate is attached to the rotor slidably and swingably.

5. The rotary compression mechanism according to claim 4, wherein:

the one end of the partition plate is swingably attached to the drive cylinder and the other end of the partition plate is formed of a flat plate; and the flat plate is supported between two shoes each formed of a cylindrical surface and a flat surface.

6. The rotary compression mechanism according to claim 1, wherein:

the partition plate is formed of a flat plate; and one end of the flat plate is attached to the rotor slidably to make contact with an inner peripheral surface of the drive cylinder, or is attached to the drive cylinder slidably to make contact with an outer peripheral surface of the rotor.

7. The rotary compression mechanism according to claim 1, wherein:

a rotor of an electric motor is connected integrally along an outer periphery of the drive cylinder; and the drive cylinder is provided in a range of an axial length of the rotor of the electric motor along the first rotation center or in a range where at least partially overlapping the axial length.

8. The rotary compression mechanism according to claim 1, wherein the shaft that is not rotatable supports the drive cylinder to rotate about the first rotation center, and supports the rotor to rotate about the second rotation center.

9. The rotary compression mechanism according to claim 1, wherein the inner peripheral groove is defined on the both side surfaces of the rotor in the axial direction.

10. The rotary compression mechanism according to claim 1, wherein a compression medium is introduced through an inlet channel defined in the shaft and discharged from a discharge port defined in the drive cylinder, the inlet channel is located at a position corresponding to a center of the rotor, and the discharge port is located on both ends of the drive cylinder in the axial direction.

11. The rotary compression mechanism according to claim 1, wherein the shaft has a first support portion supporting the drive cylinder to rotate about the first rotation center, and a second support portion supporting the rotor to rotate about the second rotation center, and a radial dimension of the shaft is made smaller as extending from the second support portion to the first support portion, such that the shaft is able to be assembled to the drive cylinder and the rotor which are assembled to each other in advance.

* * * * *